US005249716A

United States Patent [19]

O'Sullivan

[11] Patent Number: 5,249,716

[45] Date of Patent: Oct. 5, 1993

[54] CAULKING NOZZLE ASSEMBLY

[76] Inventor: Paul O'Sullivan, 28021 Camino Santo Domingo, San Juan Capistrano, Calif. 92675

[21] Appl. No.: 46,099

[22] Filed: Apr. 12, 1993

[51] Int. Cl.[5] ..... B67D 5/72

[52] U.S. Cl. ..... 282/568; 222/326; 222/527

[58] Field of Search ..... 222/326, 327, 526, 527, 222/567, 568, 566, 541; 239/600, 602, DIG. 12

[56] References Cited

U.S. PATENT DOCUMENTS

| | | | |
|---|---|---|---|
| 2,751,116 | 6/1956 | O'Brian | 222/567 X |
| 2,754,033 | 7/1956 | Etter | 222/326 |
| 2,788,159 | 4/1957 | Crewe | 222/326 |
| 2,836,333 | 5/1958 | Woodel . | |
| 2,953,285 | 9/1960 | McKelvey | 222/567 |
| 2,968,441 | 1/1961 | Holcomb . | |
| 2,981,449 | 4/1961 | Perkins | 222/541 |
| 3,058,632 | 10/1962 | Stremmel . | |
| 3,439,839 | 4/1969 | Schumann et al. | 222/568 X |
| 3,658,213 | 4/1972 | Plumer | 222/326 |
| 3,722,762 | 3/1973 | Mann | 222/568 |
| 4,528,161 | 7/1985 | Eckert . | |
| 4,946,081 | 8/1990 | Jacobson . | |
| 4,957,225 | 9/1990 | Childers | 222/568 |
| 5,000,360 | 3/1991 | Lown et al. | 222/568 X |
| 5,029,738 | 7/1991 | Dillon . | |
| 5,097,994 | 3/1992 | Washam . | |
| 5,104,013 | 4/1992 | Hawley . | |

*Primary Examiner*—Kevin P. Shaver
*Attorney, Agent, or Firm*—Price, Gess & Ubell

[57] ABSTRACT

The caulking nozzle assembly is a flexible caulk-dispensing tube which is readily attached and removed from a caulk canister's spout dispenser by use of an attaching nut which is fitted over one end of the caulk-dispensing tube. The caulking nozzle assembly further includes a curved angle guide tube that fits over the caulk-dispensing tube. As the angle guide tube is stiffer than the caulk-dispensing tube fitted therein, proper placement of the angle guide tube over the caulk-dispensing tube provides a caulking nozzle assembly which acts as an extension of the spout dispenser and which directionally dispenses the caulking material to surfaces which are difficult to reach in accordance with the shape of the angle guide tube.

14 Claims, 2 Drawing Sheets

CAULKING NOZZLE ASSEMBLY

BACKGROUND OF THE INVENTION

1. Field of the Invention

The present invention relates to a caulking nozzle assembly for dispensing a caulking material and, more particularly, to a caulking nozzle assembly which can be detachably mounted to a spout dispenser of a caulk canister for directional dispensing of the caulking material.

2. Description of Related Art

The sealing art is generally cognizant of adapters which may be used to regulate the discharge of a caulking material from its canister. Representative prior art in the field of caulking nozzle assemblies is included below.

U.S. Pat. No. 2,836,333 relates to a ferrule for extrusion nozzles on containers of plastic materials where the nozzle is utilized to control and direct the flow of plastic material. U.S. Pat. No. 2,968,441 discloses a spray nozzle assembly for use with an aerosol can. U.S. Pat. No. 3,058,632 relates to an extension accessory for a caulking tube. U.S. Pat. No. 4,528,161 teaches processor control of flexible pipette tubing. U.S. Pat. No. 4,946,081 discloses an applicator nozzle for sealant cartridges. U.S. Pat. No. 5,029,738 discloses an elongated dispensing tube and a forward conical dispensing tip. U.S. Pat. No. 5,097,994 teaches a pouring spout including a medially-positioned accordion extensible and retractable conduit. U.S. Pat. No. 5,104,013 teaches a caulking tube nozzle adapter adjustable for different caulk bead sizes.

Although a variety of caulking nozzle adapters exist, the art is still devoid of a convenient, easily-mounted caulking nozzle assembly which directionally dispenses caulk from a canister. Existing caulk nozzle adapters often consist of many parts and may not be suitable for applying the caulking material to surfaces which are difficult to reach, such as behind plumbing and heating fixtures.

OBJECTS AND SUMMARY OF THE INVENTION

An object of the present invention is to provide a caulking nozzle assembly which securely attaches to a caulk-containing canister and remains attached thereto while caulk is passed through the caulking nozzle assembly.

Another object is to provide a caulking nozzle assembly that may be quickly and easily attached to and removed from the spout dispenser of a caulk canister.

An additional object is to provide a caulking nozzle assembly that securely grips the caulk-containing canister's spout dispenser and directionally dispenses caulk from the caulking nozzle assembly.

Still another object of the present invention is to provide a caulking nozzle assembly which simply and inexpensively solves the problem of applying a caulking material to surfaces which are difficult to reach.

The caulking nozzle assembly includes a caulk-dispensing tube, an attaching universal nut, and an angle guide tube. The caulk-dispensing tube is made of a flexible material, such as plastic, and may be shaped as desired by fitting the stiffer, curved angle guide tube thereabout. The attaching nut is fit around the caulk-dispensing tube between the angle guide tube and a ferrule formed close to the end of the caulk-dispensing tube. The attaching nut includes a threaded interior surface which grips a caulk-containing canister's tip when twisted thereover. The spout dispenser of a caulk canister is secured to the caulk-dispensing tube when the attaching nut's threaded interior surface engages the spout dispenser. The ferrule keeps the caulk-dispensing tube positioned within the attaching nut as the spout dispenser of the caulk canister is pulled over the ferrule and toward the caulk-dispensing tube. After the caulk-dispensing tube is attached to the caulk canister's spout dispenser, the caulking material contained within the caulk canister may be directionally dispensed in accordance with the curved shape imposed upon the caulk-dispensing tube by the angle guide tube.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a caulking nozzle assembly which securely attaches to a caulk-containing canister and directionally dispenses caulk therefrom.

Figure 2:
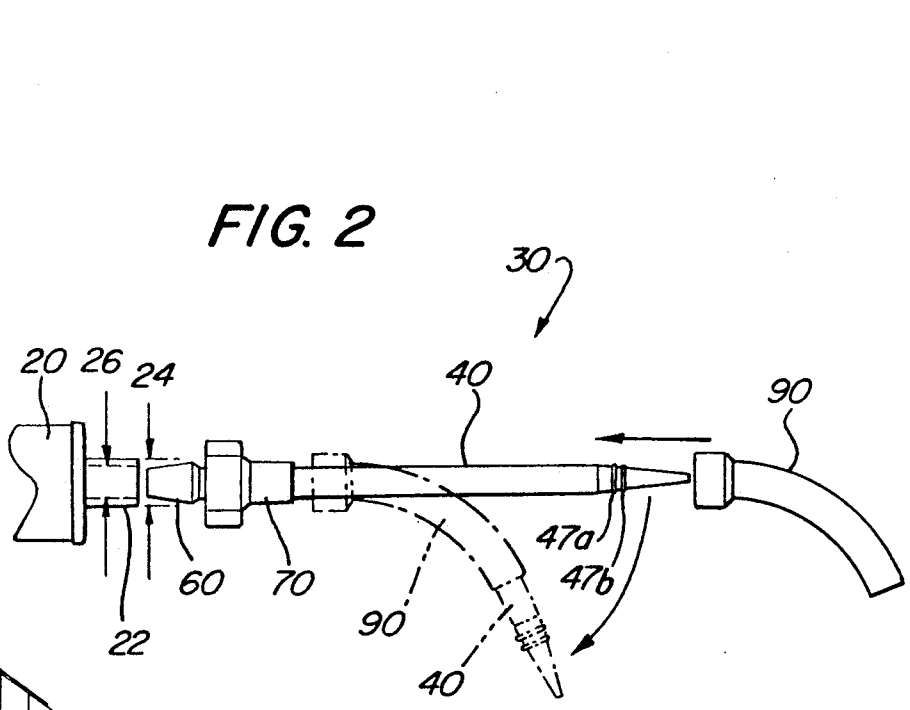
FIG. 2 shows the caulking nozzle assembly and caulk canister of FIG. 1, wherein the caulk-dispensing tube is not attached to the caulk canister's spout dispenser, and wherein the angle guide tube is not fitted over the caulk-dispensing tube.
Figure 1:
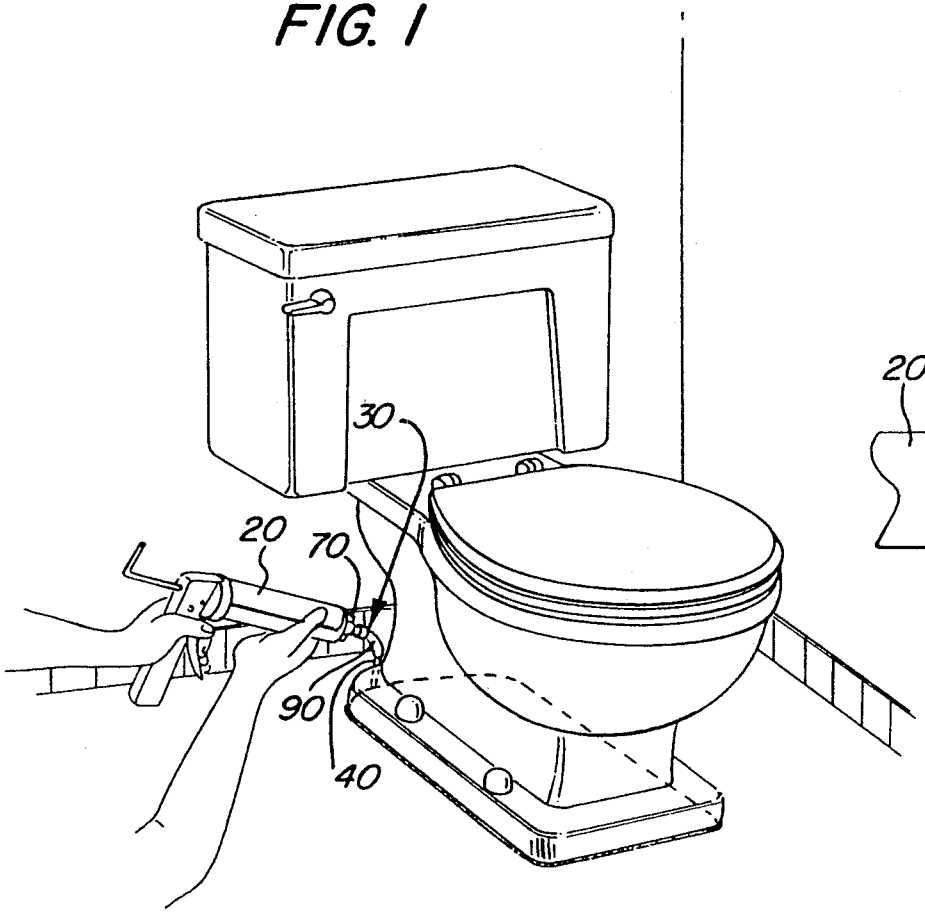
FIG. 1 is a schematic perspective showing a caulking nozzle assembly attached to a spout dispenser of a caulk canister.

FIG. 1 shows a caulk canister 20 and a caulking nozzle assembly 30 being used to apply a caulking material around the base of a toilet. FIG. 2 shows that caulking nozzle assembly 30 attaches to the end of a caulk canister 20 serving as an extension thereof. Caulking nozzle assembly 30 includes a caulk-dispensing tube 40, an attaching nut 70, and an angle guide tube 90.

As a preface to a more detailed description of caulking nozzle assembly 30, a brief discussion of the materials from which caulking nozzle assembly 30 is formed follows. FIG. 2 shows that angle guide tube 90 is fitted over caulk-dispensing tube 40. Accordingly, caulk-dispensing tube 40 is made of a material which is sufficiently flexible to conform to the shape of angle guide tube 90 when angle guide tube 90 is fitted over caulk-dispensing tube 40. Caulk-dispensing tube 40 may be made from a plastic, such as a medium density polyethylene or other similarly flexible material. Angle guide tube 90, although stiffer than caulk-dispensing tube 40, may also be made of a plastic material, such as a high density polyethylene.

Figure 5:
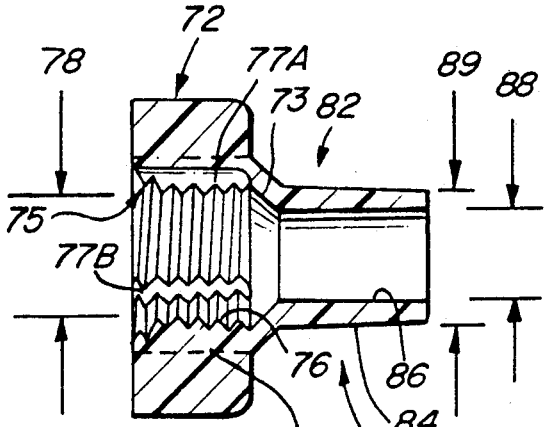
FIG. 5 is a cross-sectional side view of the attaching nut.

Caulk canister 20 includes a spout dispenser 22 into which caulk-dispensing tube 40 is received. The caulk-dispensing tube 40 is secured to spout 22 by the attaching nut 70. FIG. 5 shows that attaching nut 70 includes a threaded section interior surface 76. Accordingly, attaching nut 70 is made of a material which is harder than spout 22 so that spout 22 is self-threaded when the caulking nozzle assembly 30 is mated thereto. Preferably, attaching nut 70 is a durable plastic such as Delrin (manufactured by DuPont), and does not substantially deform as attaching nut 70 is twisted over the softer plastic of spout 22. A brief introduction to the mechanical aspects of the caulking nozzle assembly 30 follows.

Figure 3:
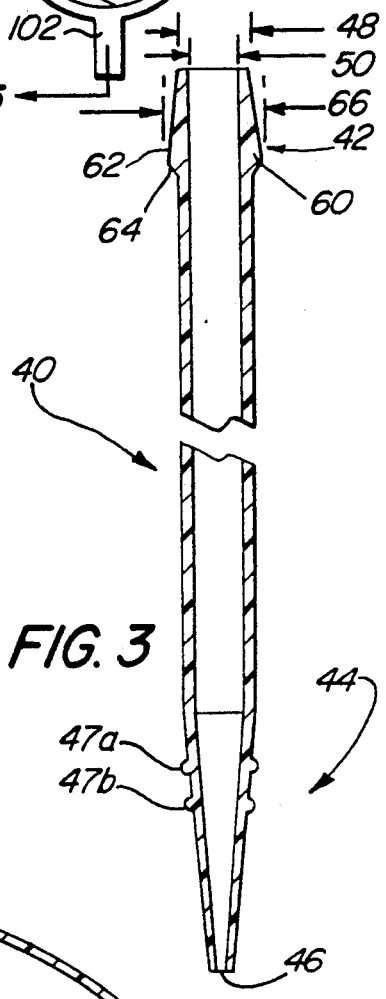
FIG. 3 is a cross-sectional side view of the caulk-dispensing tube.

FIG. 2 shows how the components of the caulking nozzle assembly 30 interfit and how the caulking nozzle assembly 30 mates to the caulk canister 20. Spout 22 is typically tapered and, as such, may be trimmed to fit over the caulk-dispensing tube 40. Alternatively, the external diameter of tube 40 is selected to fit within a standard internal diameter of a spout 22 which is not tapered. FIG. 3 illustrates that caulk-dispensing tube 40 includes an attaching end 42 and a dispensing end 44. A ferrule 60 is formed on, or molded to, attaching end 42 and reinforces the walls of dispensing tube 40 when caulking material is hydraulically, or otherwise, pushed therethrough. The caulk-dispensing tube 40 is secured to spout 22 by the attaching nut 70, which can be fitted around caulk-dispensing tube 40 between the ferrule 60 and the angle guide tube 90. FIG. 5 shows that attaching nut 70 includes a threaded section interior surface 76 designed to grip spout 22 when attaching nut 70 is pushed toward spout 22 and twisted. A reduced-diameter section 73 between the threads 76 and the sheathing section 82 can securely contact the complementary surface of the ferrule 60. Accordingly, caulk-dispensing tube 40 mates to spout 22 and thereby serves as an extension of spout 22.

Caulking nozzle assembly 30 is advantageous in that it securely attaches to a caulk-containing canister 20 and remains attached thereto while a caulk material is passed through caulk-dispensing tube 40. Another advantage of caulk nozzle assembly 30 is that it may be quickly and easily attached to and removed from spout 22 of caulk canister 20. Although caulk-dispensing tube 40 is disposable, attaching nut 70 and angle guide tube 90 are reusable without needing to be internally cleaned. The following detailed description of a preferred embodiment of caulking nozzle assembly 30 supports the aforedescribed advantages, and also teaches a caulking nozzle assembly 30 which simply and inexpensively solves the problem of applying a caulking material to surfaces which are difficult to reach. Principle elements of caulk nozzle assembly 30 will be discussed in the following order: caulk-dispensing tube 40, angle guide tube 90, and attaching nut 70.

FIG. 3 shows that caulk-dispensing tube 40 is hollow and tapers to a tip 46 on dispensing end 44. With the exception of dispensing end 44, caulk-dispensing tube 40 is characterized by an outer dispensing tube diameter 48 and an inner dispensing tube diameter 50. These dimensions of caulk-dispensing tube 40 are substantially constant along caulk-dispensing tube 40, except for the portion thereof described as dispensing end 44. At dispensing end 44, the outer and inner dispensing tube diameters, 48, 50, proportionally decrease until dispensing end 44 meets tip 46. Tip 46 is severed from caulk-dispensing tube 40 at any desired interval so that caulk-dispensing tube 40 may serve as a conduit for a caulking material contained within caulk canister 20 and dispense a desired diameter bead of caulking material. The tapered shape of dispensing end 44 permits the user of caulking nozzle assembly 30 to sever tip 46 at a location along dispensing end 44 appropriate for dispensing caulk in desired quantities.

Additionally, dispensing end 44 includes O-rings **47*a*, 47 *b*, which are formed on, or molded to, dispensing end 44, as seen in FIG. 3. O-rings 47*a*, 47*b* permit a slip-on fitting (not shown), with a complementary pair of O-rings within its interior, to be fitted over dispensing end 44 and friction lock thereto. The slip-on fitting serves as an extension of caulk-dispensing tube 40** and forms a "friction fastening system" therewith. The slip-on fitting functions as a caulk applicator for applying caulk to surfaces which are particularly difficult to reach and for dispensing a caulk bead of a desired diameter or shape.

Figure 7:
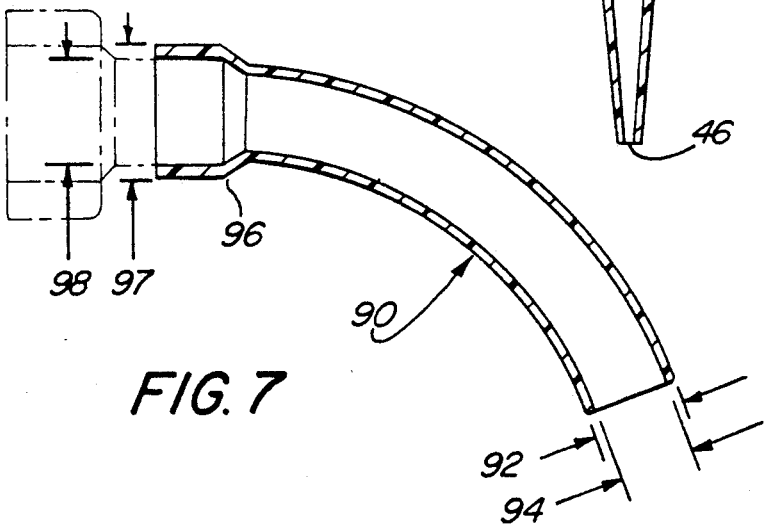
FIG. 7 is a cross-sectional side view of the angle guide tube.

FIG. 7 shows an angle guide tube 90 which is characterized by an outer guide tube diameter 92 and an inner guide tube diameter 94. Angle guide tube 90 can be curved in shape, with the inner guide tube diameter 94 being slightly larger than the outer dispensing tube diameter 48. As such, angle guide tube 90 is sized to closely fit over caulk-dispensing tube 40. Angle guide tube 90 is stiffer than caulk-dispensing tube 40 and, accordingly, bends caulk-dispensing tube 40 when fitted thereover. Angle guide tube 90 also includes a flanged end 96 with an outer flanged end diameter 97 and an inner flanged end diameter 98. Caulk-dispensing tube 40 enters into angle guide tube 90 at flanged end 96.

Angle guide tube 90 is shorter in length than caulk-dispensing tube 40. Therefore, angle guide tube 90 may be positioned anywhere along caulk-dispensing tube 40 between attaching nut 70 and dispensing end 44. However, FIGS. 1, 5, and 7 illustrate that inner flanged end diameter 98 is slightly larger than outer sheathing section diameter 89 so that flanged end 96 may be fit over and thereby secured to sheathing section 82 if desired. Thus, when a caulking material is passed through caulk-dispensing tube 40, angle guide tube 90 provides a flexible means for directionally dispensing the caulking material to surfaces which are difficult to reach, as shown in FIG. 1.

Figure 4:
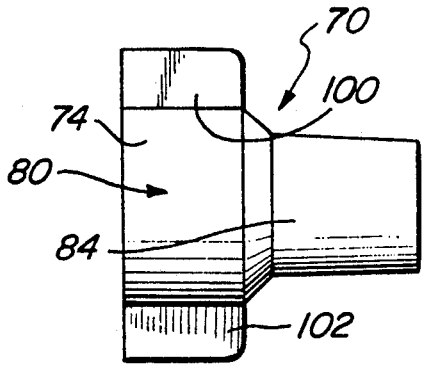
FIG. 4 is a side view of the attaching nut.
Figure 6:
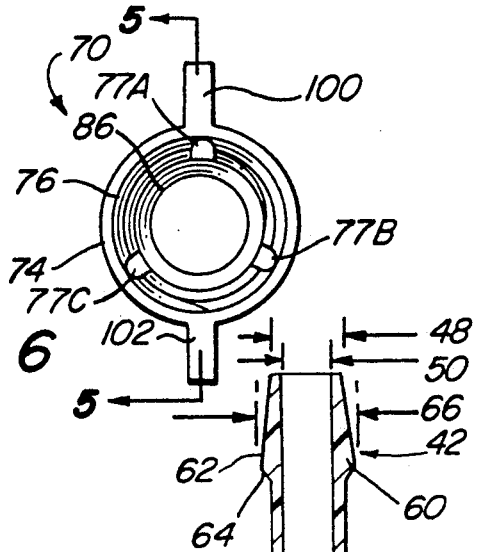
FIG. 6 is a view of the attaching end of the attaching nut.

FIGS. 4–6 illustrate that molded attaching nut 70 includes a threaded section 72 and a sheathing section 82. Attaching nut 70 is characterized by an attaching nut exterior surface 80 including threaded section exterior surface 74 and sheathing section exterior surface 84. Attaching nut 70 fits over caulk-dispensing tube 40 between ferrule 60 and angle guide tube 90. As shown in FIG. 3, ferrule 60 includes an attaching surface 62 and a stopping surface 64. Ferrule 60 has an outer ferrule diameter 66 which is greater than the inner sheathing section diameter 88 shown in FIG. 5. More specifically, sheathing section interior surface 86, which fits closely around caulk-dispensing tube 40, defines inner sheathing section diameter 88 which is slightly larger than outer dispensing tube diameter 48 and smaller than outer ferrule diameter 66. Thus, attaching nut 70 is confined over caulk-dispensing tube 40 and between ferrule 60 and angle guide tube 90. Stopping surface 64 contacts and is complementary to reduced-diameter section 73 and, accordingly, prevents attaching nut 70 from sliding off the caulk-dispensing tube 40 in the direction of attaching end 42.

Threaded section 72 of attaching nut 70 includes threaded section exterior surface 74 and threaded section interior surface 76, as can be seen in FIG. 5. Threaded section interior surface 76 defines inner threaded section diameter 78, which is larger than outer ferrule diameter 66. Threaded section 72 further includes step-down threads 75 which expand the open end of threaded section 72 to a size slightly larger than inner threaded section diameter 78 so that spouts 22 of varying size and shape are more easily received into attaching nut 70. Additionally, and as seen in FIG. 6, threaded section interior surface 76 includes three taping gates *77a*, *77b*, *77c*, which enhance the ability of threaded section 72 to cut into spout 22.

Operationally, threaded section 72 substantially encircles the attaching end 42 and the ferrule 60 formed thereon so that a caulk canister spout 22 may be received over attaching end 42 and within attaching nut 70. As seen in FIG. 2, the tapered spout 22 of caulk canister 20 is trimmed to have an outer spout diameter 24 and an inner spout diameter 26. Outer spout diameter 24 is less than inner threaded section diameter 78. Inner spout diameter 26 is greater than outer dispensing tube diameter 48 and, preferably, smaller than outer ferrule diameter 66 such that spout 22 makes contact with attaching surface 62 when attaching nut 70 grips spout 22. Fundamental in the operation of caulking nozzle assembly 30 is the "true ferrule" action wherein ferrule 60 fits within and expands inner spout diameter 26 to increase the locking pressure of the attachment process.

FIG. 4 shows that attaching nut 70 includes a first wing 100 and a second wing 102 formed on attaching nut exterior surface 80. In a preferred embodiment, wings 100, 102 are diametrically opposed and located on threaded section exterior surface 74. The purpose of wings 100, 102 is to provide a gripping means whereby attaching nut 70 can be pushed toward and twisted over spout 22. Such pressing and twisting causes attaching nut 70's threaded section interior surface 76 to engage spout 22 and pull spout 22 toward the attaching end 42 of caulk-dispensing tube 40. Attaching end 42 and ferrule 60 remain within attaching nut 70's threaded section 72, notwithstanding a force exerted upon the attaching end 42 when spout 22 is pulled thereagainst, because the outer ferrule diameter 66 is too large for attaching end 42 to be pushed into the sheathing section 82 of attaching nut 70. Thus, caulking nozzle assembly 30 attaches to caulk canister 20 and permits a caulking material contained within caulk canister 20 to be directionally dispensed in accordance with the shape of angle guide tube 90.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A caulking nozzle assembly for dispensing a caulking material from a canister of caulking material having a spout dispenser, the caulking nozzle assembly comprising:

a caulk-dispensing tube with an attaching end and a dispensing end, the dispensing tube includes a ferrule formed on the attaching end;

an angle guide tube curved in shape and sized to fit closely around said dispensing tube, said dispensing tube being less rigid than the guide tube and substantially flexing to assume the guide tube's shape when inserted therein; and attaching means for connection to the spout, the attaching means closely fitting around said dispensing tube between said ferrule and said angle guide tube, said ferrule prevents the attaching means from sliding off said dispensing tube in the direction of said dispensing tube's attaching end;

whereby said attaching means can be removably attached to the spout of said caulk canister to said dispensing tube, said dispensing tube being subjectively shaped by the operator by positioning said angle guide tube to directionally dispense, from said dispensing end, said caulking material discharged from said caulking canister and received into said dispensing tube's attaching end.

2. The caulking nozzle assembly of claim 1:

wherein said caulk-dispensing tube is made of a first plastic material;

wherein said angle guide tube is made of a second plastic material which is stiffer than said first plastic material; and wherein said attaching means is made of a third plastic material which is harder than said first plastic material.

3. A caulking nozzle assembly for dispensing a caulking material from a canister of caulking material having a spout dispenser, the caulking nozzle assembly comprising:

a caulk-dispensing tube with an inner dispensing tube diameter and an outer dispensing tube diameter, the dispensing tube includes an attaching end and a dispensing end, the attaching end includes a ferrule with an outer ferrule diameter formed on the attaching end; and an attaching nut including a sheathing section and a threaded section, the sheathing section with an inner sheathing section diameter larger than said outer dispensing tube diameter and smaller than said outer ferrule diameter, the threaded section includes a threaded section interior surface with an inner threaded section diameter larger than said outer ferrule diameter, the attaching nut fits over said dispensing tube such that the threaded section substantially encircles said attaching end and said ferrule and such that the sheathing section fits over said dispensing tube between said ferrule and said dispensing end;

wherein said spout dispenser is received by said attaching nut and secured to said attaching end when said attaching nut is pressed toward said received spout and twisted, such pressing and twisting causes said attaching nut's threaded section interior surface to engage said spout and pull said spout toward said attaching end, said attaching end and said ferrule remain within said attaching nut's threaded section, notwithstanding a force exerted upon said attaching end when said spout is pulled thereagainst, because said outer ferrule diameter is too large for said attaching end to be pushed into said attaching nut's sheathing section;

thus said caulking nozzle assembly attaches to said caulk canister and permits said caulking material contained within said caulk canister to be dispensed through said dispensing tube.

4. The caulking nozzle assembly of claim 3, further comprising:

an angle guide tube curved in shape with an inner guide tube diameter and an outer guide tube diameter, the inner guide tube diameter is slightly larger than said outer dispensing tube diameter and, as such, the angle guide tube is sized closely to fit about said dispensing tube between said attaching nut's sheathing section and said dispensing end, the outer guide tube diameter is larger than the inner guide tube diameter, the angle guide tube is stiffer than said dispensing tube and accordingly bends said dispensing tube when fit thereover;

thus said caulking nozzle assembly attaches to said caulk canister and permits said caulking material contained within said caulk canister to be directionally dispensed in accordance with said angle guide tube's curved shape.

5. The caulking nozzle assembly of claim 4:

wherein said caulk-dispensing tube is made of a first plastic material;

wherein said angle guide tube is made of a second plastic material which is stiffer than said first plastic material; and wherein said attaching nut is made of a third plastic material which is harder than said first plastic material.

6. The caulking nozzle of claim 3, wherein said attaching nut is molded.

7. The caulking nozzle of claim 3, wherein said attaching nut has an exterior surface and further comprises gripping means for gripping said attaching nut, said gripping means being attached to the exterior surface of said attaching nut.

8. The caulking nozzle of claim 3, wherein said attaching nut has an exterior surface and further comprises a first wing and a second wing for gripping said attaching nut, the wings being formed on the exterior surface of said attaching nut.

9. A caulking nozzle assembly for dispensing a caulking material from a canister of caulking material having a tapered spout dispenser, the caulking nozzle assembly comprising:

a caulk-dispensing tube with an inner dispensing tube diameter and an outer dispensing tube diameter, the dispensing tube includes an attaching end to which is molded a ferrule with an outer ferrule diameter, the dispensing tube includes a dispensing end, the inner and outer dispensing tube diameters are essentially constant along the dispensing tube except near the dispensing end where said diameters decrease proportionally such that the dispensing tube tapers to a tip at the dispensing end, said dispensing tube's tip can be severed from the dispensing tube at an appropriate location near the dispensing end to facilitate passage of said caulking material through said dispensing tube; and an attaching nut including a sheathing section and a threaded section, the sheathing section with an inner sheathing section diameter larger than said outer dispensing tube diameter and smaller than said outer ferrule diameter, the threaded section includes a threaded section interior surface with an inner threaded section diameter larger than said outer ferrule diameter, the attaching nut fits over said dispensing tube such that the threaded section substantially encircles said attaching end and said ferrule and such that the sheathing section fits over said dispensing tube between said ferrule and said dispensing end;

wherein said tapered spout dispenser is trimmed to have an inner spout diameter larger than said outer dispensing tube diameter and an outer spout diameter smaller than said attaching nut's inner threaded section diameter enabling the caulk canister's trimmed spout to fit within said attaching nut and over said attaching end;

wherein said caulk canister's trimmed spout mates to said attaching end when said attaching nut is pressed toward said received trimmed spout and twisted, such pressing and twisting causes said attaching nut's threaded section interior surface to engage said trimmed spout and pull said trimmed spout toward and over said attaching end, said attaching end and said ferrule remain within said attaching nut's threaded section, notwithstanding a force exerted upon said attaching end when said trimmed spout is pulled thereagainst, because said outer ferrule diameter is too large for said attaching end to be pushed into said attaching nut's sheathing section;

thus said caulking nozzle assembly attaches to said caulk canister and permits said caulking material contained within said caulk canister to be dispensed through said dispensing tube.

10. The caulking nozzle assembly of claim 9, further comprising:

an angle guide tube curved in shape with an inner guide tube diameter and an outer guide tube diameter, the inner guide tube diameter is slightly larger than said outer dispensing tube diameter, and as such, the angle guide tube is sized closely to fit about said dispensing tube between said attaching nut's sheathing section and said dispensing end, the outer guide tube diameter is larger than the inner guide tube diameter, the angle guide tube is stiffer than said dispensing tube and accordingly bends said dispensing tube when fit thereover;

thus said caulking nozzle assembly attaches to said caulk canister and permits said caulking material contained within said caulk canister to be directionally dispensed in accordance with said angle guide tube's curved shape.

11. The caulking nozzle assembly of claim 10:

wherein said caulk-dispensing tube is made of a first plastic material;

wherein said angle guide tube is made of a second plastic material which is stiffer than said first plastic material; and wherein said attaching nut is made of a third plastic material which is harder than said first plastic material.

12. The caulking nozzle of claim 9, wherein said attaching nut is molded.

13. The caulking nozzle assembly of claim 9, wherein said attaching nut has an exterior surface and further comprises gripping means for gripping said attaching nut, said gripping means being attached to the exterior surface of said attaching nut.

14. The caulking nozzle assembly of claim 9, wherein said attaching nut has an exterior surface and further comprises a first wing and a second wing for gripping said attaching nut, the wings being formed on the exterior surface of said attaching nut.

* * * * *